United States Patent [19]

Harris

[11] Patent Number: 4,779,386

[45] Date of Patent: Oct. 25, 1988

[54] SCOURING BLOCK FOR CLEANING RUBBER AND THE LIKE

[76] Inventor: Thomas W. Harris, 305 Second St., Albemarle, N.C. 28001

[21] Appl. No.: 478,475

[22] Filed: Mar. 24, 1983

[51] Int. Cl.[4] ..... B24D 15/02

[52] U.S. Cl. ..... 51/205 R; 51/16; 51/295; 15/104.93

[58] Field of Search ..... 51/204, 205 R, 213, 51/293, 298, 16, 394, 407, 328, 211 R, 211 H, 212, 181 R, 276, 295, DIG. 20–DIG. 21, DIG. 23; 15/104.93

[56] References Cited

U.S. PATENT DOCUMENTS

| | | | |
|---|---|---|---|
| 86,636 | 2/1869 | Bloede | 51/DIG. 20 |
| 618,880 | 2/1899 | Humphrey | 51/211 R |
| 735,156 | 8/1903 | Schanzlin | 51/276 |
| 1,059,566 | 4/1913 | Rodgers | 51/211 R |
| 2,395,054 | 2/1946 | Levine | 51/295 |
| 2,674,072 | 4/1954 | Lohmann | 51/211 R |
| 2,802,317 | 8/1957 | Stuck | 51/213 |
| 3,001,334 | 9/1961 | Giusti et al. | 51/3 |
| 3,330,077 | 7/1967 | Kanbar et al. | 51/205 R |
| 3,707,012 | 12/1972 | Lane | 15/104.93 |
| 4,142,334 | 3/1979 | Kirsch et al. | 15/104.93 |

FOREIGN PATENT DOCUMENTS

| | | | |
|---|---|---|---|
| 0977159 | 11/1975 | Canada | 51/211 R |

*Primary Examiner*—Robert P. Olszewski

*Attorney, Agent, or Firm*—Clifton Ted. Hunt

[57] ABSTRACT

An abrasive scouring block is provided for cleaning rubber, such as the sidewalls of automobile tires, by rubbing the block against the surface of the rubber while rinsing it with water.

12 Claims, 2 Drawing Sheets

SCOURING BLOCK FOR CLEANING RUBBER AND THE LIKE

FIELD OF THE INVENTION

This invention relates to a scouring block specifically structured for the cleaning of rubber and the like.

BACKGROUND OF THE INVENTION

Rubber, such as the side walls of automobile tires, has heretofore been cleaned by various means, including soap pads made of metal mesh embedded with soap which are wetted and rubbed against the tire to clean it. The tire is then rinsed to wash away the soap and dirt. The use of such soap pads is generally objectional because the abrasive action results in the pad becoming separated and not suitable for further use after only a small area of the tire hase been cleaned. The use of expensive brushes and chemicals in cleaning tires is also objectional in instances where the chemical adversely affects the tire or the metal hub caps and rims contacted by the chemical. General household cleaning compounds have been used to clean tires but they are generally inefficient and messy. All of these prior art procedures are relatively slow compared to the cleaning of rubber with use of the present invention and rinsing with water.

The patented prior art includes a scourer for kitchen utensils, a device for abrasion cleaning of concrete, a rubbing block including sandstone or artificial sandstone for finishing automobile bodies, and a scourer formed from a serrated wooden block to clean marble and stone as disclosed in U.S. Pat. Nos. 2,386,900; 3,564,779; 1,896,946; and 409,652, respectively. None of the patented art, to applicant's knowledge, discloses a device particularly structured, as is applicant's, to clean rubber and the like.

SUMMARY OF THE INVENTION

Applicant's scouring block comprises stone dust and a binder which, when molded, forms a monolithic block which can be used with only water to quickly and efficiently clean rubber, such as automobile tires.

The sidewalls of tires are generally smooth surfaced (except for the raised lettering and numbers) and applicant has found that the surface of a tire, or other rubber product, is susceptible of being permanently scratched or peeled away if the cleaning block has too coarse a texture.

It is therefore, an object of this invention to provide an abrasion cleaning device adapted to be manually or otherwise rubbed against rubber to clean it without scratching or peeling the surface of the rubber.

Another object of the invention is to provide an abrasion cleaning device for rubber which is easy to use and does not require the use of any substance other than water to effectively clean the rubber.

A further object of the invention is to provide a monolithic cleaning block which is durable and wear-resistant in use. This is advantageous in the cleaning of raised letters on tires because the edges of the raised letters dig into prior art cleaning pads and tear them apart after only limited use.

A still further object of the invention is to provide a scouring device for rubber which may be impregnated with a chemical cleaner, if desired, to facilitate the cleaning of certain materials from rubber.

DETAILED DESCRIPTION OF THE INVENTION

Figure 1:
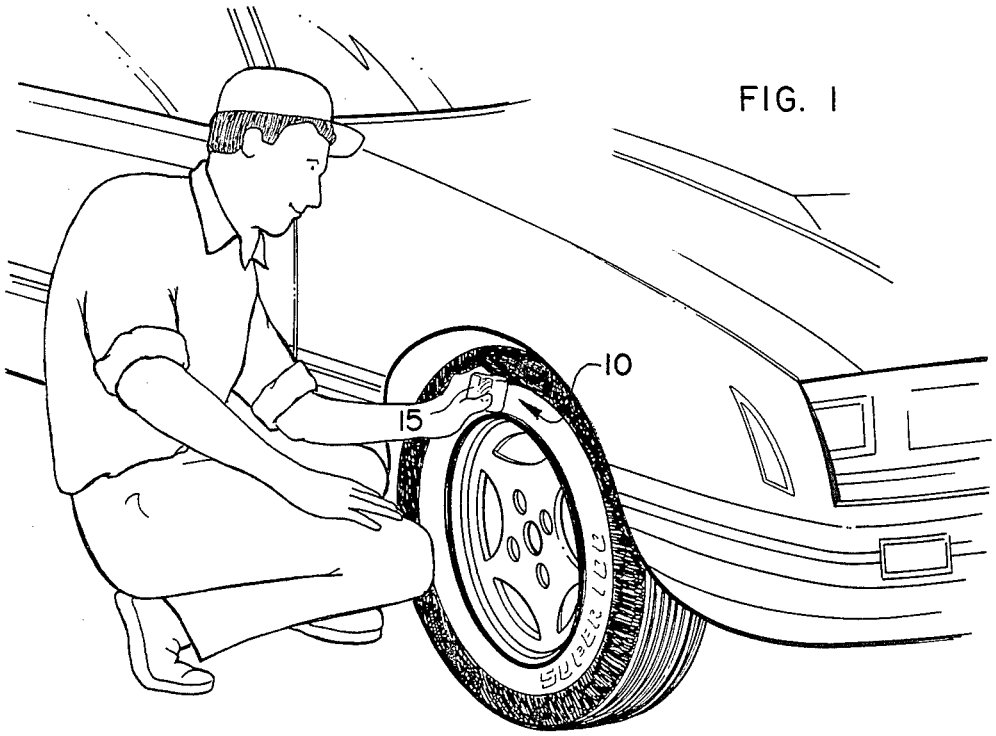
FIG. 1 is a fragmentary perspective view, with parts broken away, illustrating use of the scouring device to clean a smooth rubber surface such as a tire.
Figure 2:
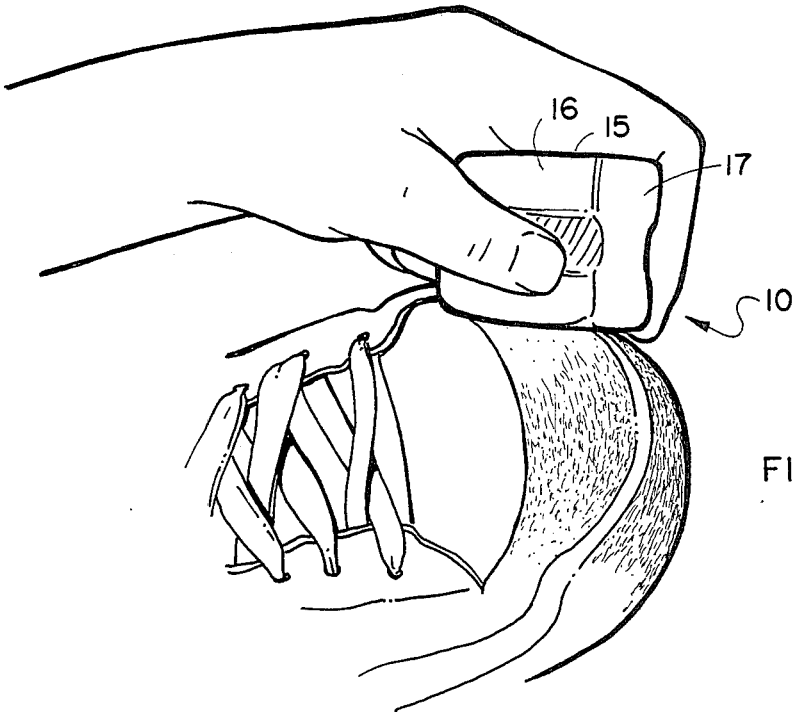
FIG. 2 is a fragmentary perspective view, with parts broken away, illustrating use of the device to clean textured rubber such as found on the sides of tennis shoes.

Referring more specifically to the drawings, the scouring device or block of the present invention is broadly indicated at 10 and comprises a block suitably shaped as desired for hand or machine use and formed from pulverized abrasive material or grit held together with a binder such as cement or polyester resin.

One successful embodiment of the invention utilizes one hundred pounds of U.S. No. 40-200 granite dust blended with 50 pounds of U.S. No. 15-M granite dust and thoroughly mixed. U.S. grit size No. 15-M may be defined as grit that will pass through U.S. 325 mesh. Three parts by weight of the grit mixture are combined with one part by weight of a binder such as polyester resin and a conventional catalyst within a mold to produce the scouring device 10 of any desired pre-determined configuration and dimension. In the illustrated embodiment, the block 10 is shaped and dimensioned for hand use but it may be shaped and dimensioned for use with a machine such as a rotary mandrel if desired.

The foregoing example is illustrative only, it being within the scope of the invention to use any size grit which will not scratch the surface of the rubber when rubbed against it with hand pressure. U.S. No. 12 grit size, which is about the size of building sand, has been found to be too coarse for successful cleaning of rubber because it tends to scratch the surface of the rubber. Particles of stone, such as granite or marble, having a maximum grit size smaller than U.S. No. 12 grit size have been found to be practical for use in the abrading block of the present invention. In general, it is preferable to use a fine grit size on smooth surfaced rubber and a relatively coarse grit size on a textured rubber surface. The described mixture of U.S. grit size No. 40-200 and U.S. grit size No. 15-M has been found to provide a good general purpose block.

Referring again to the illustrated embodiment, the scouring device 10 is of monolithic construction and includes a working surface 11 and a holding portion 12. For convenient handling, a longitudinal groove 13 extends between the working surface 11 and handle portion 12 on both sides of the stone. The grooves 13 provide a convenient resting place for the fingers of the user when applying the working surface to the rubber.

The working surface 11 is of curvilinear configuration, which facilitates the application of uniform pressure to the rubber, particularly when using long strokes. The handle portion 12 has a flat surface 15 opposite the working surface 11 and the side walls 16 and end walls 17 of the block 10 are arranged in perpendicular relation to each other and extend perpendicularly from the flat surface 15 of the handle portion 12 to the curvilinear working surface 11. The location of the longitudinal grooves 13 between the curvilinear working surface 11 and the flat surface 15 of the handle portion 12 enables the block 10 to be grasped with the flat surface 15 of the handle portion 12 extending outwardly for engagement with the rubber when desired. For example, the edges of raised letters on tires and the space between the raised letters may be more conveniently and effectively cleaned by rubbing them with the flat surface 15 and with the sharp edges at the junctures of the side walls of the block with the flat surface of its handle portion. The corners at the junctures of the flat surface with perpendicularly extending side walls and end walls of the block 10 present useful rubbing surfaces for tight places, such as the space between portions of a raised letter on a tire.

The surface of rubber tires is generally smooth except for the raised surfaces conventionally used for lettering.

Figure 3:
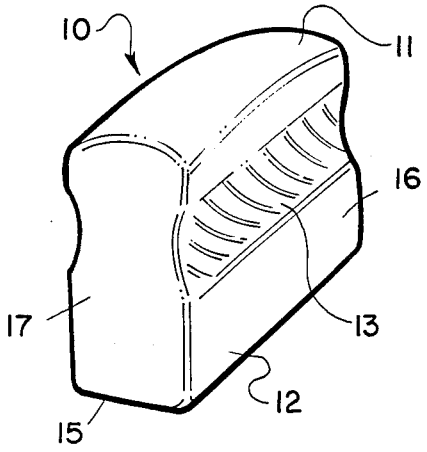
FIG. 3 is a perspective view looking at the working surface of the scouring stone.
Figure 4:
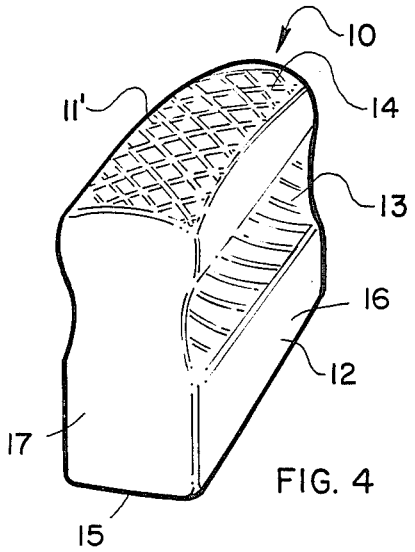
FIG. 4 is a perspective view looking at the working surface which has been serrated in accordance with a first modified form of the invention.

Textured surfaces on rubber can be more quickly cleaned with a modified work surface indicated at 11[1] in FIG. 4. The work surface 11[1] is defined by serrations 14 formed in the work surface and resulting in an irregular or textured surface 11[1]. The textured surface 11[1] reaches the indentations on a textured rubber surface such as found on the sides and/or toe portions of some tennis shoes, making it possible to clean the shoe more quickly than with the smooth surface 11 on the block shown in FIG. 3.

In practice, the surface to be cleaned is wetted while the block 10 is rubbed back and forth on the surface. The abrasive action of the block loosens the grime and dirt which is washed away by the water.

A chemical cleaner may sometimes be desirable as a supplement to the abrasive action of the block. The block may be soaked in a suitable chemical, such as sold commercially under the trademark LOC or under the trademark JANITOR IN A DRUM. After soaking for several hours the block 10 becomes sufficiently impregnated with the chemical to retain it and gradually release it while the block is being rubbed against a rubber surface to be cleaned and rinsed with water.

Alternatively, the chemical cleaner may be incorporated into the formulation of grit and binder. For example, the foregoing example of three (3) parts of grit and one (1) part binder by weight may be modified by adding to that mixture a quantity of dry chemical cleaner such as sold under the trademark AJAX sufficient to be up to 10% of the mixture. The resulting block may be rubbed against rubber with water as previously explained, and the chemically treated block will produce suds when used with water.

Figure 5:
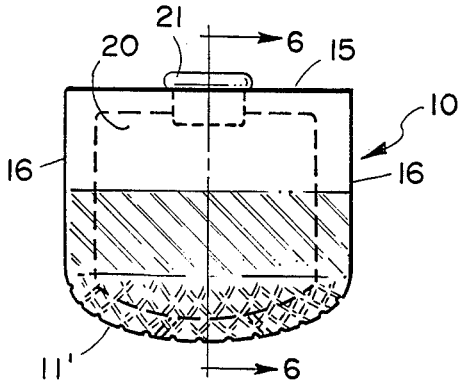
FIG. 5 is a side view of a further modified form of the invention.
Figure 6:
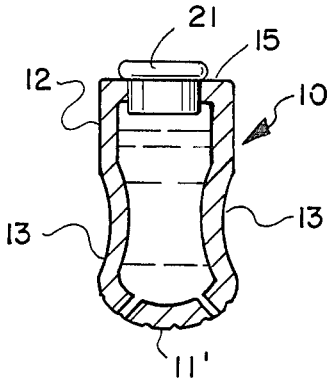
FIG. 6 is a sectional view taken substantially along the Line 6—6 in FIG. 5.

Referring to FIGS. 5 and 6, a modified form of the block 10 is illustrated wherein the block is formed from three (3) parts stone grit (preferably granite or marble) and one (1) part binder (preferably polyester resin or cement), as in the principal form of the invention, but wherein the block 10 has an interior cavity or reservoir 20 communicating with the flat surface 15 of the handle portion 12 and closed by a plug or stopper 21. The reservoir may be filled with a liquid chemical cleaner of the type previously described or other desired type, and the chemical may be slowly fed to the working surface 11 or 11[1] through small ports 22 extending from the reservoir and communicating with the working surface, as most clearly seen in FIG. 6.

Although specific terms have been employed in describing the invention, they have been used in a descriptive sense only and not for purposes of limitation.

I claim:

1. A tool for cleaning dirt, smudge, grease and the like from smooth, textured and irregular surfaces of soiled rubber, said tool comprising a rigid block shaped to define selective working surfaces of different configurations for engagement with different surfaces of the soiled rubber, and the working surfaces of said block being formed of stone grit smaller than U.S. No. 12 grit size and a binder, whereby the soiled rubber may be cleaned by rubbing its surface with a selected working surface of said tool and rinsing with water.

2. An article of manufacture according to claim 1 wherein the grit size is a mixture of U.S. grit size No. 40-200 and U.S. grit size No. 15-M.

3. An article of manufacture according to claim 2 wherein two pounds of U.S. grit size No. 40-200 are used for every pound of U.S. grit size No. 15-M.

4. An article of manufacture according to claim 3 wherein the stone grit is granite and wherein the amount of binder is one-third the amount of grit by weight and wherein the binder is a polyester resin and a catalyst.

5. An article of manufacture according to claim 1 wherein the binder is cement.

6. An article of manufacture according to claim 1 wherein the binder is a polyester resin and a catalyst.

7. An article of manufacture according to claim 1 wherein the block includes a working surface and a handle portion.

8. An article of manufacture according to claim 7 wherein the block includes grooves between the working surface and the handle portion to facilitate gripping of the block.

9. An article of manufacture according to claim 7 wherein the block has a reservoir communicating with the working surface, whereby a liquid may be placed in the reservoir and transmitted to the working surface and a surface to be cleaned.

10. An article of manufacture according to claim 1 wherein the block includes a dry chemical cleaner mixed with the stone grit and binder.

11. An article of manufacture according to claim 1 which has been soaked in a liquid chemical cleaner.

12. An article of manufacture for cleaning rubber comprising a monolithic rigid block formed from stone grit and a binder, said block including a curvilinear working surface and an angular handle portion, said angular handle portion including a flat surface opposite the curvilinear working surface and side walls and end walls arranged in perpendicular relation to each other and extending perpendicularly from the flat surface of the handle to the curvilinear working surface to define sharp edges at the junctures of the side walls with the end walls and flat surface of the handle portion; whereby the curvilinear working surface facilitates the application of uniform pressure to the rubber while making long strokes and the sharp edges facilitate cleaning of the surface of the rubber between raised portions of the rubber.

* * * * *